US012344438B2

(12) United States Patent
Aagaard

(10) Patent No.: US 12,344,438 B2
(45) Date of Patent: Jul. 1, 2025

(54) PLASTIC BAG STORAGE CONTAINER

(71) Applicant: Patti Ann Aagaard, Sherman Oaks, CA (US)

(72) Inventor: Patti Ann Aagaard, Sherman Oaks, CA (US)

( * ) Notice: Subject to any disclaimer, the term of this patent is extended or adjusted under 35 U.S.C. 154(b) by 6 days.

(21) Appl. No.: 18/555,842

(22) PCT Filed: Jun. 15, 2022

(86) PCT No.: PCT/US2022/033562
§ 371 (c)(1),
(2) Date: Oct. 17, 2023

(87) PCT Pub. No.: WO2022/266185
PCT Pub. Date: Dec. 22, 2022

(65) Prior Publication Data

US 2024/0208694 A1 Jun. 27, 2024

Related U.S. Application Data

(63) Continuation-in-part of application No. 29/795,633, filed on Jun. 18, 2021, now Pat. No. Des. 965,980.
(Continued)

(51) Int. Cl.
*B65D 25/38* (2006.01)
*B65D 25/34* (2006.01)
*B65D 43/16* (2006.01)

(52) U.S. Cl.
CPC ..... *B65D 25/38* (2013.01); *B65D 25/34* (2013.01); *B65D 43/163* (2013.01); *B65D 2203/00* (2013.01); *B65D 2543/00203* (2013.01)

(58) Field of Classification Search
CPC ..... B65D 25/38; B65D 25/34; B65D 43/163; B65D 2203/00; B65D 2543/00203; B65D 43/168
See application file for complete search history.

(56) References Cited

U.S. PATENT DOCUMENTS 2,971,688 A * 2/1961 Akers ..... B65D 5/02 229/126
4,863,052 A * 9/1989 Lambert ..... A61B 50/36 229/131.1

(Continued)

FOREIGN PATENT DOCUMENTS

CN 207060755 U 3/2018
CN 111232447 A 6/2020

OTHER PUBLICATIONS

Calibrador De Globos Cubo Madera Para Decoracion Fiesta 9 Tamaños 12 Pulgadas US ebay.com https://www.ebay.com/itm/313528985042?chn=ps&mkevt=1&mkcid=28.

*Primary Examiner* — Shawn M Braden

(57) ABSTRACT

A plastic bag storage container is an apparatus that enables users to easily store plastic bags for later reuse. The apparatus may include a removable lid, a storage enclosure, an enclosure sleeve, and at least one printed graphic. The storage enclosure is a container designed to store several plastic bags in a readily accessible manner. The removable lid is used to close the storage enclosure. The enclosure sleeve is utilized to embellish the external ornamental look of the storage enclosure. The at least one printed graphic improves the ornamental design of the enclosure sleeve. The storage enclosure includes a top base panel, a bottom base panel, a plurality of lateral panels, and a main opening. The top base panel, the bottom base panel, and the plurality of lateral panels are arranged to form the storage enclosure. The main opening enables the insertion and the dispensing of the plastic bags.

7 Claims, 10 Drawing Sheets

Related U.S. Application Data

(60) Provisional application No. 63/211,371, filed on Jun. 16, 2021.

(56) References Cited

U.S. PATENT DOCUMENTS

| | | | | |
|---|---|---|---|---|
| 4,899,905 | A * | 2/1990 | Holtsch | B65D 83/0805 221/33 |
| 5,002,200 | A * | 3/1991 | Hunt | A47G 29/00 D34/1 |
| 6,170,723 | B1 | 1/2001 | Howell | |
| 7,433,105 | B2 * | 10/2008 | Mau | G02B 30/40 359/742 |
| 7,870,972 | B2 | 1/2011 | Elefante | |
| 8,746,544 | B2 | 6/2014 | Cruz | |
| 10,173,832 | B2 | 1/2019 | Chatelain | |
| 2005/0023183 | A1 | 2/2005 | Banik et al. | |
| 2019/0021559 | A1 | 1/2019 | Twerski | |

* cited by examiner

PLASTIC BAG STORAGE CONTAINER

The current application is a 371 of international Patent Cooperation Treaty (PCT) application PCT/US2022/033562 filed on Jun. 15, 2022. The PCT application PCT/US2022/033562 claims a priority to a U.S. provisional application Ser. No. 63/211,371 filed on Jun. 16, 2021.

The current application also claims a priority to a U.S. design application Ser. No. 29/795,633 filed on Jun. 18, 2021 and issued as U.S. Pat. No. D965,980 on Oct. 11, 2022.

FIELD OF THE INVENTION

The present invention relates generally to storage containers and household organizational items. More specifically, the present invention provides a novel storage container designed to store several bags, such as plastic bags, in a readily available and practical manner.

BACKGROUND OF THE INVENTION

Nowadays, different storage containers are available designed to retain and store different items. A storage container is any receptacle or enclosure for holding or storing objects. The objects are protected when placed inside the storage box structure. The storage container can be made of a variety of durable materials, such as plastic, wood, and metal. Further, the container is typically rectangular, though the container may be square, circular, oval, or any appearance. With the rise in popularity of recycling and waste reduction, various storage containers are available to help store items that can be reused. For example, shopping bags are some of the most common items that are reused by people. Most households keep the shopping bags stored in drawers, boxes, or other containers suitable for storage. Depending on the chosen container, the shopping bags can be difficult to retrieve due to the specific shape of the container. So, a proper storage container designed to hold shopping bags is necessary.

An objective of the present invention is to provide a plastic bag storage container that stores several plastic bags in a readily accessible manner. The present invention is designed to retain plastic carry-out bags that can be reused to reduce waste. Another objective of the present invention is to provide a plastic bag storage container that facilitates the storage of the plastic bags as well as the retrieval of the plastic bags. The present invention includes a circular opening that enables the user to easily store and retrieve the plastic bags. Another objective of the present invention is to provide a plastic bag storage container that can be customized to the user's needs. The present invention can be provided with an optional lid to cover the circular opening as well as an ornamental sleeve that encloses the present invention. Additional features and benefits are further discussed in the sections below.

SUMMARY OF THE INVENTION

The present invention provides a plastic bag storage container that enables users to store plastic bags to be reused in a readily accessible manner. The present invention includes a storage enclosure designed to retain several plastic bags. The storage enclosure further includes a main opening that facilitates the insertion of plastic bags into the storage enclosure as well as the easy dispensing of the stored plastic bags. The storage enclosure is preferably cube-shaped with a size large enough to retain several plastic bags and small enough to not take too much space. The main opening is preferably a circular opening large enough to facilitate the insertion of several plastic bags at once as well as to not obstruct the retrieval of the stored plastic bags.

Furthermore, the present invention is preferably provided with customizable accessories that fit the user's needs. The present invention can include a removable lid that can be attached to the storage enclosure to close the main opening when not in use. The present invention can also include an enclosure sleeve that covers most of the storage enclosure to embellish the ornamental look of the storage enclosure without obstructing the functionality.

DETAILED DESCRIPTION OF THE INVENTION

Figure 1:
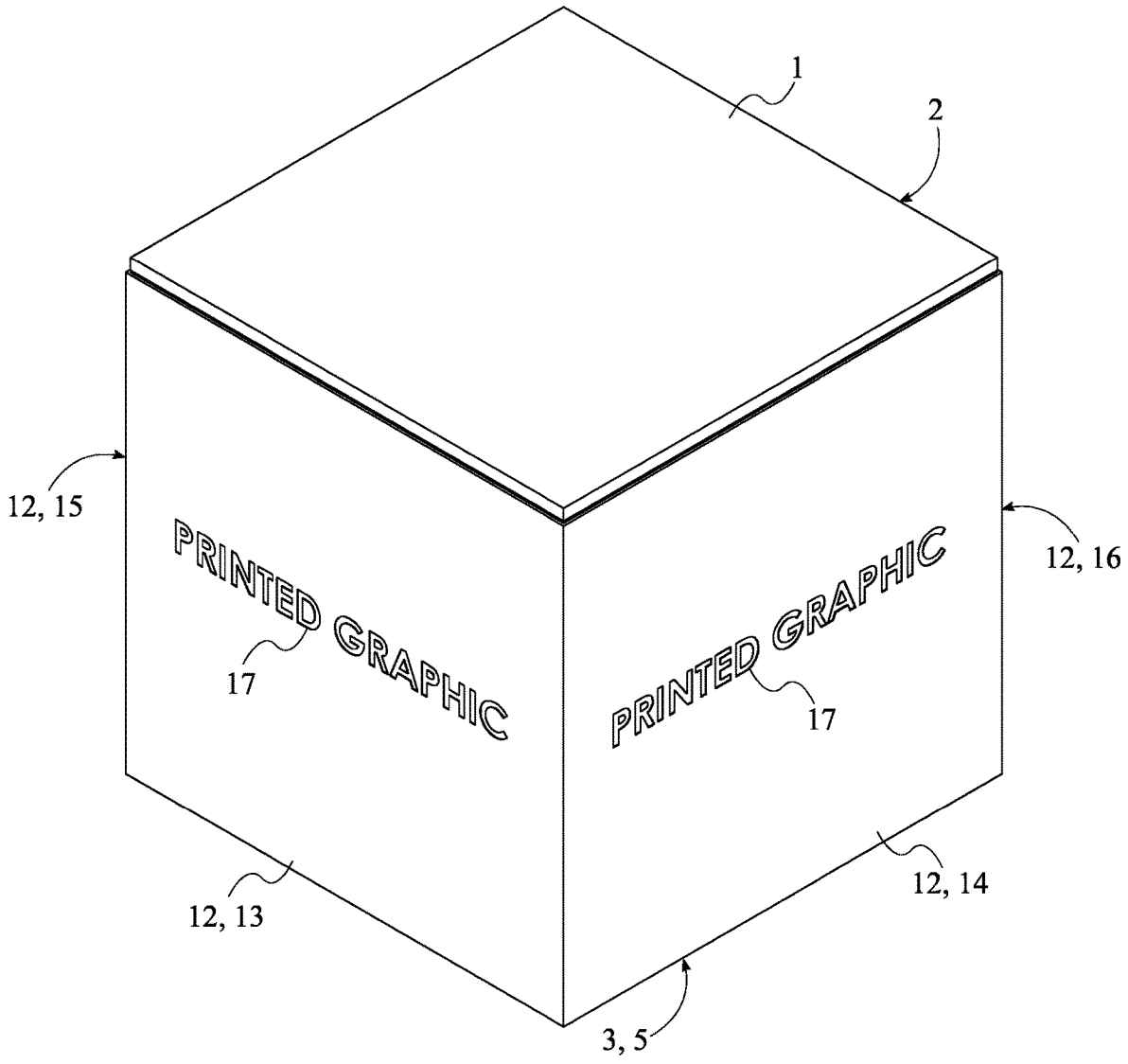
FIG. 1 is a top front perspective view of the present invention.
Figure 2:
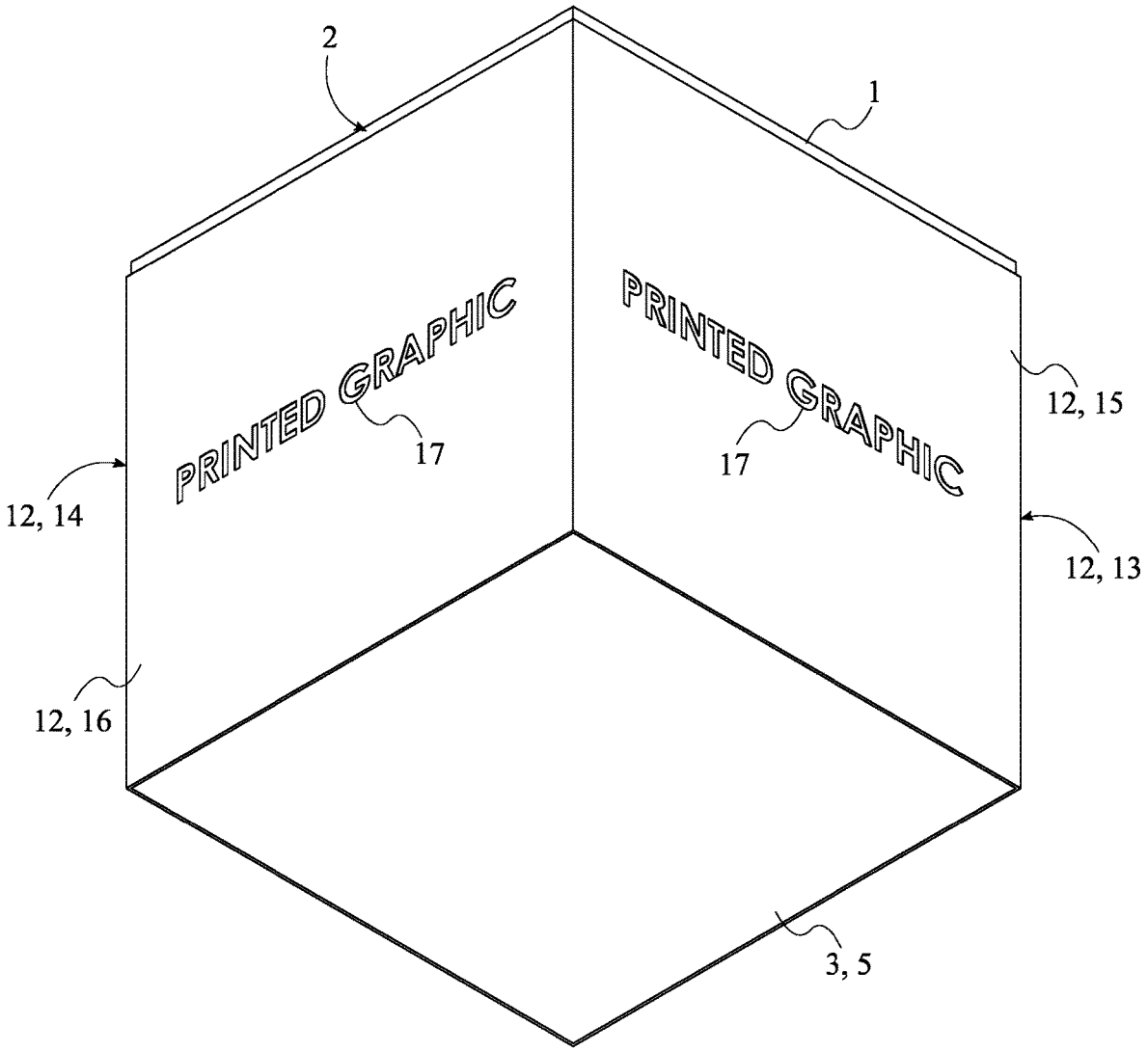
FIG. 2 is a bottom rear perspective view of the present invention.
Figure 3:
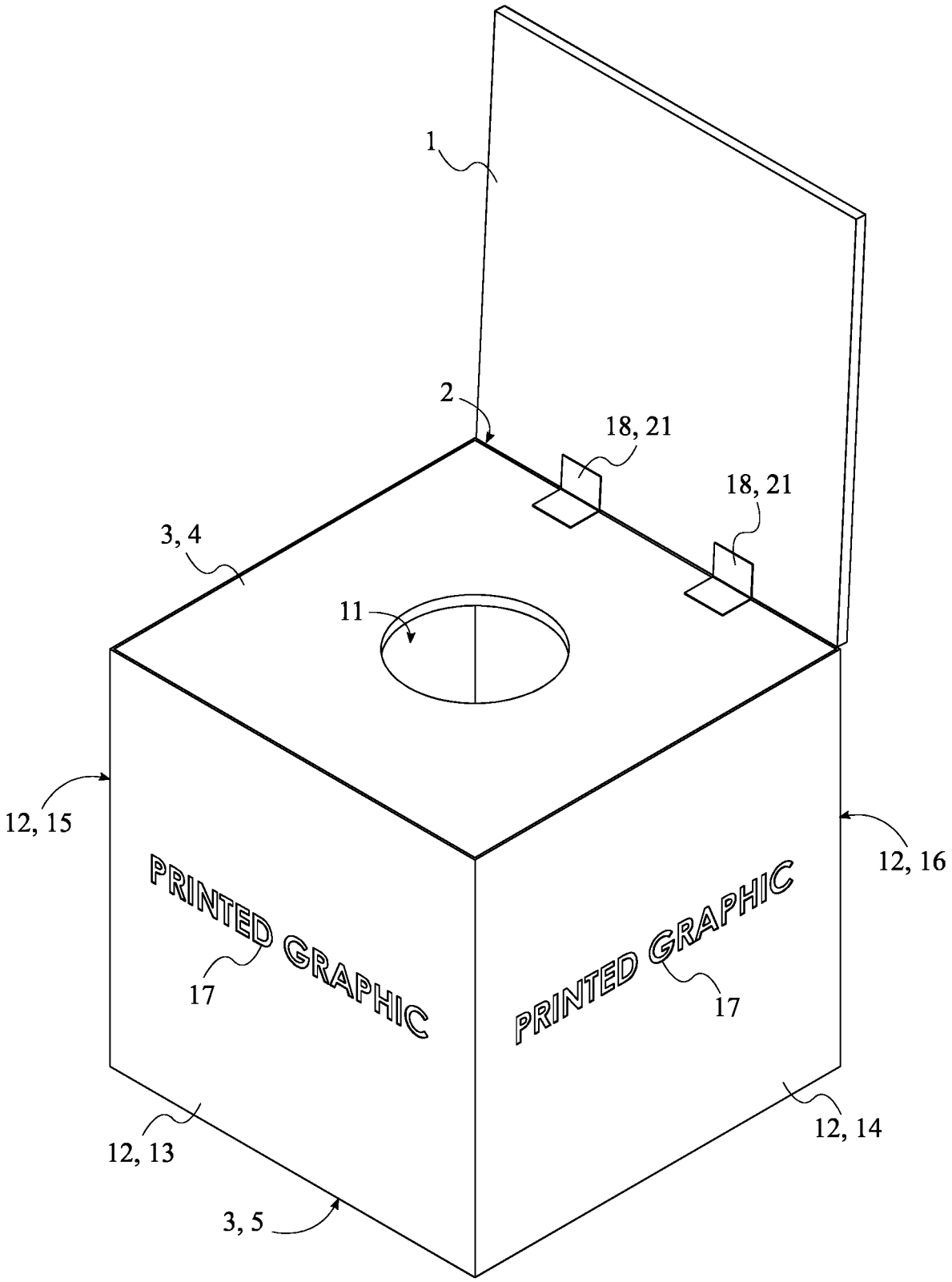
FIG. 3 is top front perspective view of the present invention, wherein the removable lid is shown in an open position.
Figure 4:
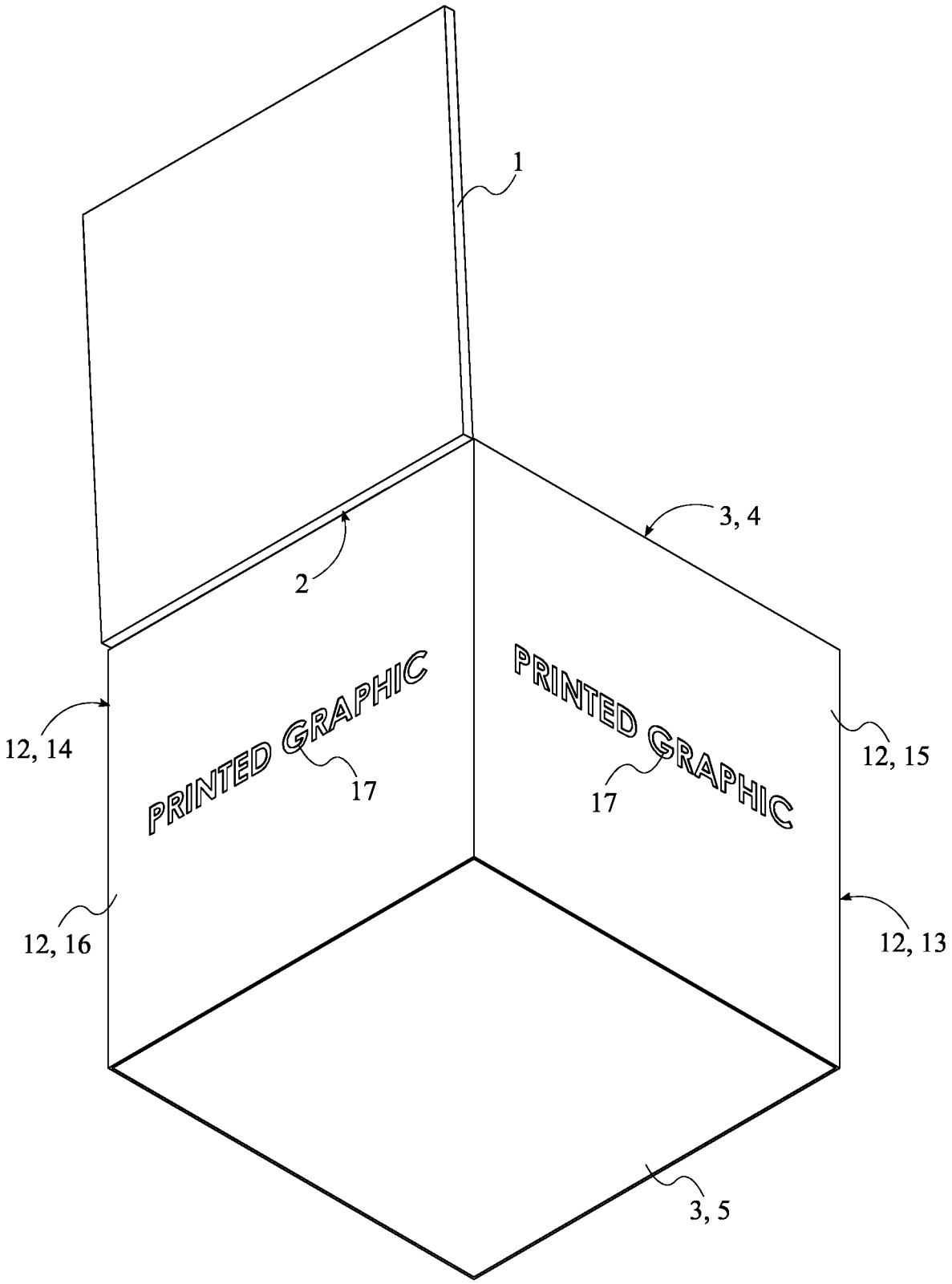
FIG. 4 is a bottom rear perspective view of the present invention, wherein the removable lid is shown in the open position.
Figure 5:
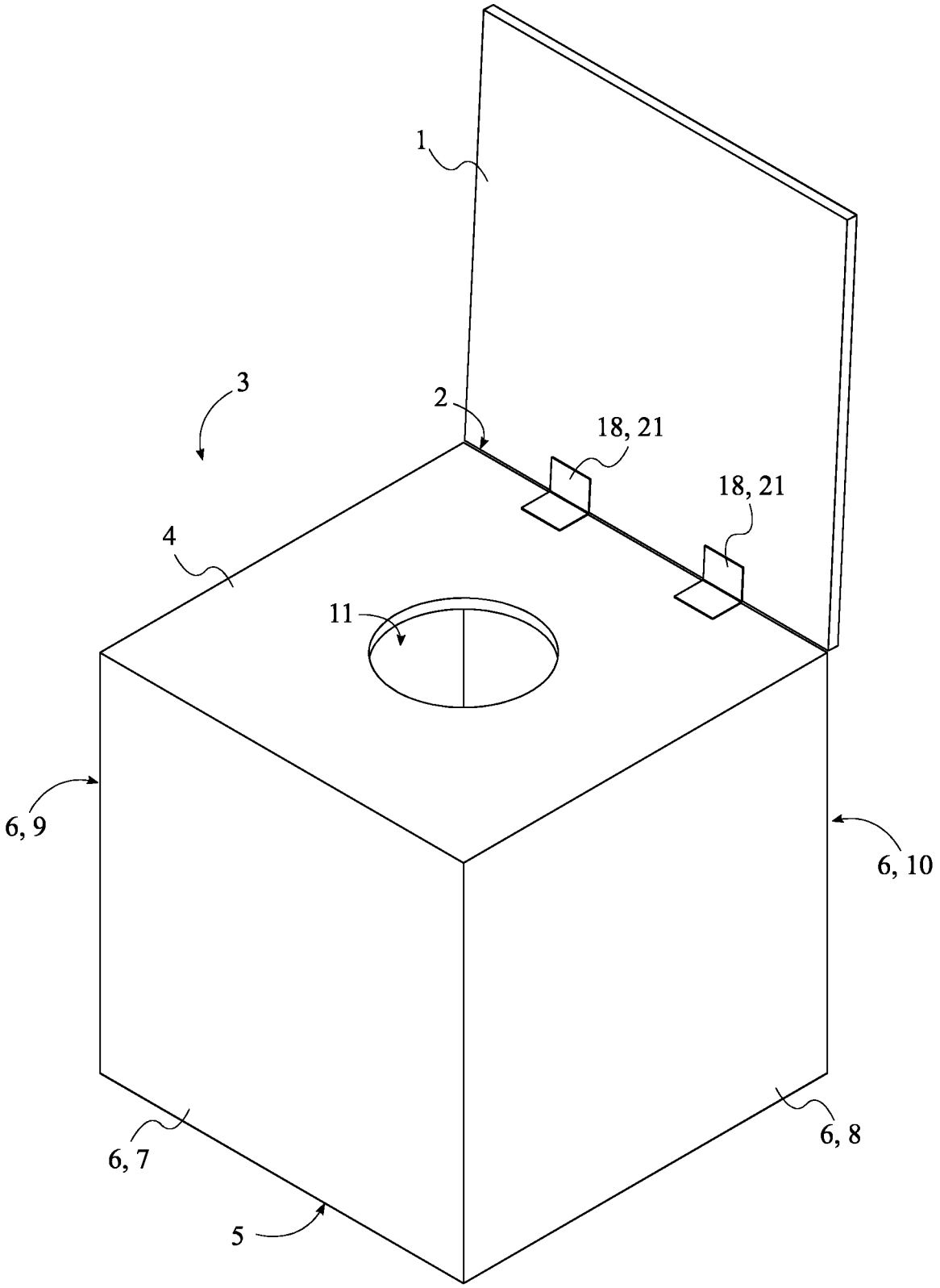
FIG. 5 is top front perspective view of the present invention, wherein the removable lid is shown in the open position, and wherein the enclosure sleeve is shown removed.
Figure 6:
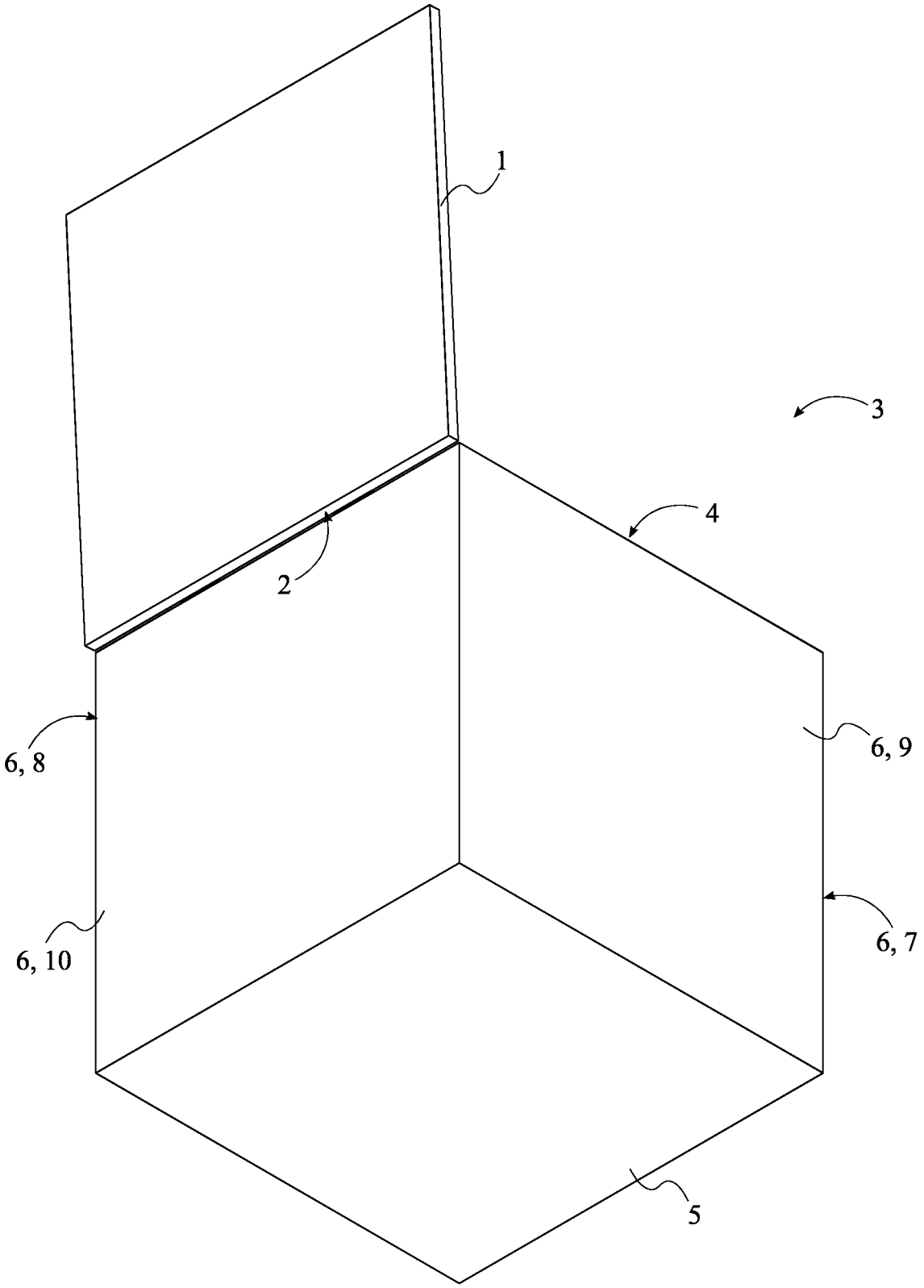
FIG. 6 is a bottom rear perspective view of the present invention, wherein the removable lid is shown in the open position, and wherein the enclosure sleeve is shown removed.
Figure 7:
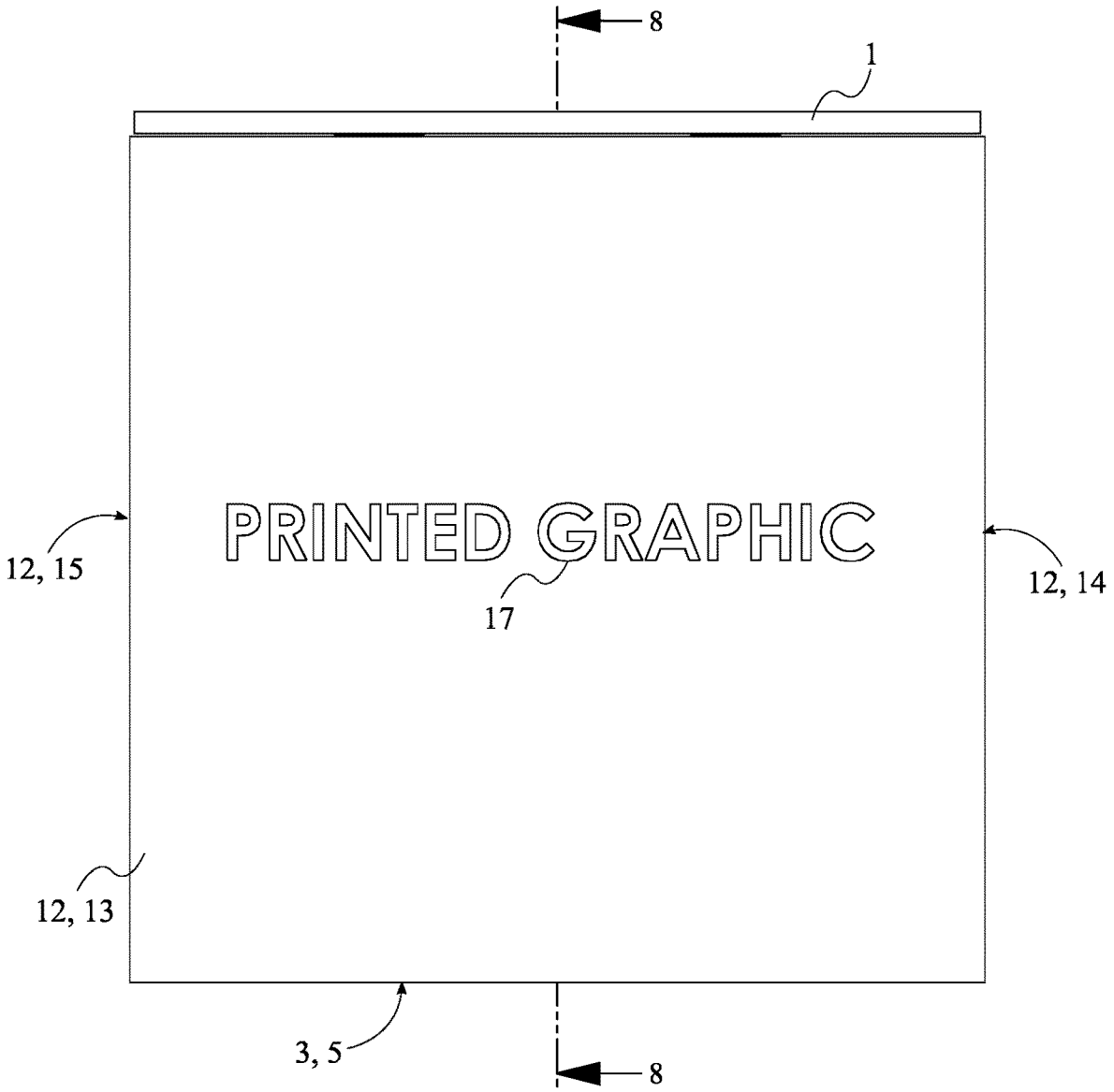
FIG. 7 is a front view of the present invention.
Figure 8:
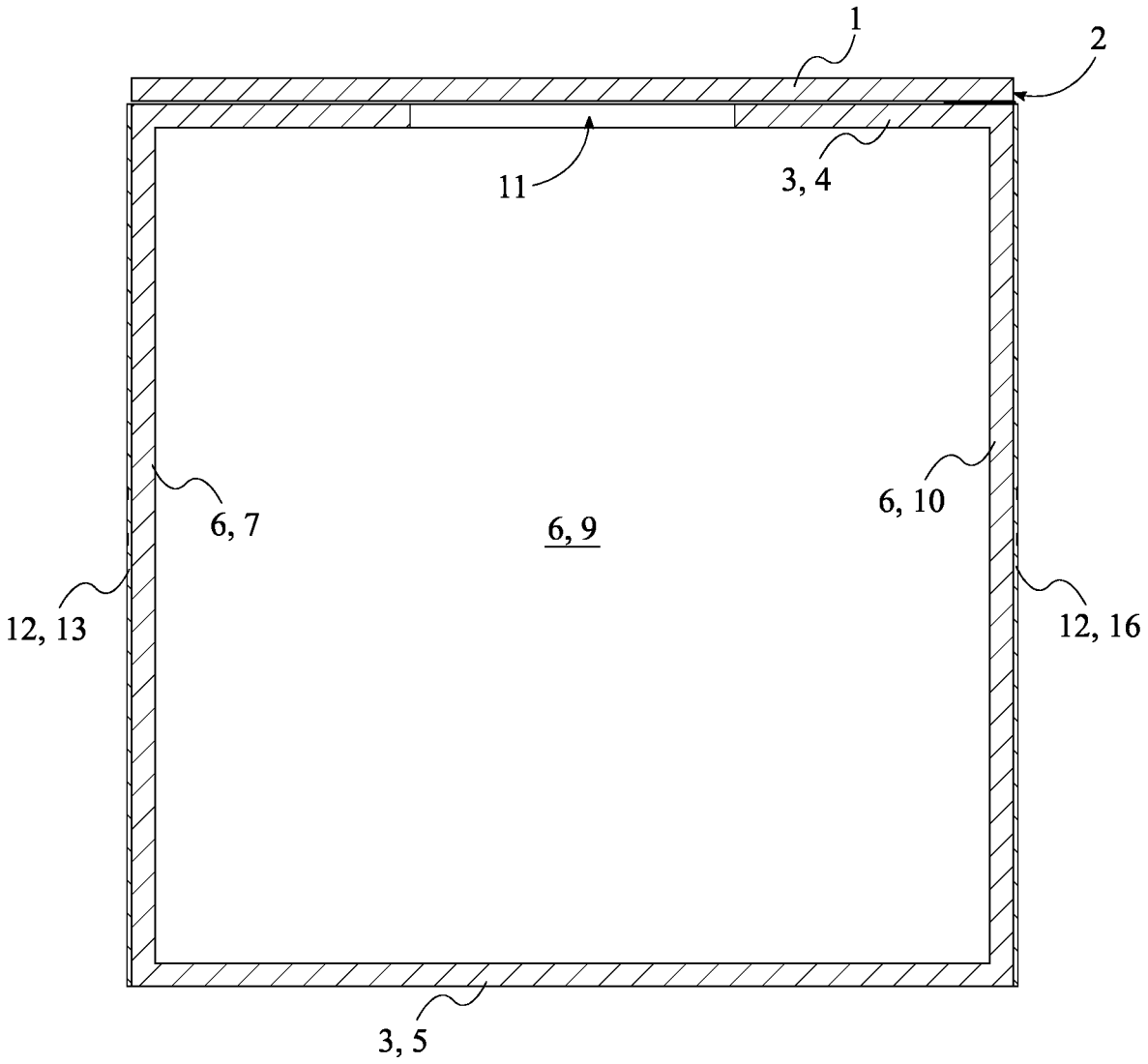
FIG. 8 is a vertical cross-sectional view taken in the direction of line 8-8 in FIG. 7.

All illustrations of the drawings are for the purpose of describing selected versions of the present invention and are not intended to limit the scope of the present invention.

The present invention is a plastic bag storage container that enables users to easily store plastic bags for later reuse. As can be seen in FIGS. 1 through 4, 9, and 10, to do so, the present invention may comprise a removable lid 1, a storage enclosure 3, an enclosure sleeve 12, and at least one printed graphic 17. The storage enclosure 3 is a container designed to store several plastic bags in a readily accessible manner. The removable lid 1 can be used to seal the storage enclosure 3 when the storage enclosure 3 is not in use. The enclosure sleeve 12 is utilized to embellish the external ornamental look of the storage enclosure 3. The at least one printed graphic 17 improves the ornamental design of the enclosure sleeve 12.

The general configuration of the aforementioned components enables users to reuse plastic bags by facilitating the storage and dispensing of the plastic bags. As can be seen in FIGS. 1 through 8, the storage enclosure 3 is a closed hollow structure large enough to retain several plastic bags. To do so, the storage enclosure 3 comprises a top base panel 4, a bottom base panel 5, a plurality of lateral panels 6, and a main opening 11. The top base panel 4, the bottom base panel 5, and the plurality of lateral panels 6 are arranged to form the closed structure of the storage enclosure 3. The main opening 11 enables the insertion of plastic bags into the storage enclosure 3 as well as the dispensing of the plastic bags from the storage enclosure 3. To form the storage enclosure 3, the top base panel 4 and the bottom base panel 5 are positioned parallel and offset from each other. The plurality of lateral panels 6 is positioned in between the top base panel 4 and the bottom base panel 5. This way, a closed structure is formed that retains the plastic bags within. Further, the main opening 11 traverses through the top base panel 4 to provide an opening through which the plastic bags can be inserted and dispensed without obstruction.

As can be seen in FIGS. 1 through 6, 9, and 10, the removable lid 1 and the enclosure sleeve 12 are preferably provided as customizable accessories that can be attached to the storage enclosure 3 if the user desires. To attach the removable lid 1 to the storage enclosure 3, the removable lid 1 is hingedly connected to the storage enclosure 3, adjacent to the top base panel 4. This way, the removable lid 1 can be opened to expose the main opening 11 and closed to seal the main opening 11 as desired. On the other hand, the enclosure sleeve 12 is designed to cover the plurality of lateral panels 6. To do so, the enclosure sleeve 12 is compressively positioned around the plurality of lateral panels 6. This way, the enclosure sleeve 12 is tightly positioned around the storage enclosure 3 without obstructing the main opening 11. Furthermore, the at least one printed graphic 17 is externally inscribed onto the enclosure sleeve 12 to add an ornamental design to the enclosure sleeve 12. However, the user may choose to utilize the storage enclosure 3 without the removable lid 1 nor the enclosure sleeve 12.

The storage enclosure 3 is designed to be positioned in an accessible location to store the plastic bags without taking too much space. This way, the storage enclosure 3 can be stored with other items in tight spaces, such as a kitchen or bathroom cabinet. As can be seen in FIGS. 5 through 10, to do so, the plurality of lateral panels 6 may comprise a front lateral panel 7, a left lateral panel 8, a right lateral panel 9, and a rear lateral panel 10. The front lateral panel 7, the left lateral panel 8, the right lateral panel 9, and the rear lateral panel 10 are preferably arranged to form an overall rectangular structure that can be stored with other items within a cabinet or similar storage space. The left lateral panel 8 is connected adjacent and perpendicular to the front lateral panel 7. Similarly, the right lateral panel 9 is connected adjacent and perpendicular to the front lateral panel 7, opposite to the left lateral panel 8. Further, the rear lateral panel 10 is connected adjacent and perpendicular to the left lateral panel 8, opposite to the front lateral panel 7. Similarly, the rear lateral panel 10 is connected adjacent and perpendicular to the right lateral panel 9, opposite to the front lateral panel 7. This way, the storage enclosure 3 is shaped to have four lateral sides with four lateral corners. Furthermore, the front lateral panel 7, the left lateral panel 8, the rear lateral panel 10, and the right lateral panel 9 are connected perpendicular in between the top base panel 4 and the bottom base panel 5 to form an overall rectangular structure that is symmetric in shape. This facilitates the storage of the storage enclosure 3 along with other items in a storage space. In the preferred embodiment, the top base panel 4, the bottom base panel 5, the front lateral panel 7, the left lateral panel 8, the rear lateral panel 10, and the right lateral panel 9 are shaped into a cube. However, in other embodiments, the top base panel 4, the bottom base panel 5, the front lateral panel 7, the left lateral panel 8, the rear lateral panel 10, and the right lateral panel 9 can be shaped into different arrangements.

As can be seen in FIGS. 5 through 10, to ensure that the storage enclosure 3 fits tightly against the plurality of lateral panels 6, the storage enclosure 3 is designed to match the arrangement of the plurality of lateral panels 6. To do so, the enclosure sleeve 12 may comprise a front lateral section 13, a left lateral section 14, a right lateral section 15, and a rear lateral section 16. The front lateral section 13, the left lateral section 14, the right lateral section 15, and the rear lateral section 16 correspond to different sections of the enclosure sleeve 12 that fit onto a corresponding panel of the plurality of lateral panels 6. So, the front lateral section 13 is positioned across the front lateral panel 7. The front lateral section 13 is also coextensive with the front lateral panel 7. This way, the front lateral section 13 completely covers the front lateral panel 7. Likewise, the rear lateral section 16 is positioned across the rear lateral panel 10. The rear lateral section 16 is also coextensive with the rear lateral panel 10. This way, the rear lateral section 16 completely covers the rear lateral panel 10. Further, the left lateral section 14 is positioned across the left lateral panel 8. The left lateral section 14 is also coextensive with the left lateral panel 8. This way, the left lateral section 14 completely covers the left lateral panel 8. Likewise, the right lateral section 15 is positioned across the right lateral panel 9. The right lateral section 15 is also coextensive with the right lateral panel 9. This way, the right lateral section 15 completely covers the right lateral panel 9. Furthermore, the at least one printed graphic 17 may be inscribed onto the front lateral section 13, the left lateral section 14, the right lateral section 15, and the rear lateral section 16 in a continuous symmetrical pattern. In other embodiments, the enclosure sleeve 12 may partially cover the plurality of lateral panels 6. The at least one printed graphic 17 may also be inscribed onto the front lateral section 13, the left lateral section 14, the right lateral section 15, and the rear lateral section 16 in an asymmetrical pattern. Further, different printed graphics may be inscribed on each lateral section.

As can be seen in FIGS. 5 through 8, to maintain the symmetrical design of the present invention, the main opening 11 is centrally positioned to the top base panel 4. This positions the main opening 11 in such a way that all the stored plastic bags can be easily retrieved from the storage enclosure 3. Further, the main opening 11 is a circular opening large enough to fit the user's hand so that the user can easily retrieve the stored plastic bags within the storage enclosure 3. The storage enclosure 3 is preferably 9½ inches wide, 9½ inches long, and 9½ inches tall. The main opening is preferably 3½ inches in diameter. Furthermore, the removable lid 1 is shaped coextensive with the top base panel 4 so that the removable lid 1 perfectly fits on top of the top base panel 4. Thus, the present invention has a symmetric and ornamentally pleasant look.

As previously discussed, the removable lid 1 is provided as an extra accessory that the user can choose to attach to the storage enclosure 3 if desired. As can be seen in FIGS. 5 through 10, to do so, the present invention may further comprise a plurality of hinges 18 that facilitate the attachment of the removable lid 1 to the storage enclosure 3. Further, the removable lid 1 may comprise a lid edge 2 which corresponds to the edge of the lid that is connected to the storage enclosure 3. To connect the removable lid 1 to the storage enclosure 3, the plurality of hinges 18 is distributed along the lid edge 2. The plurality of hinges 18 includes enough hinges that prevents the removable lid 1 from coming loose. Then, the removable lid 1 is hingedly connected to the storage enclosure 3 by the plurality of hinges 18. This way, the removable lid 1 is securely connected to the storage enclosure 3, enabling the user to easily open or close the removable lid 1 as desired without obstructions.

Figure 9:
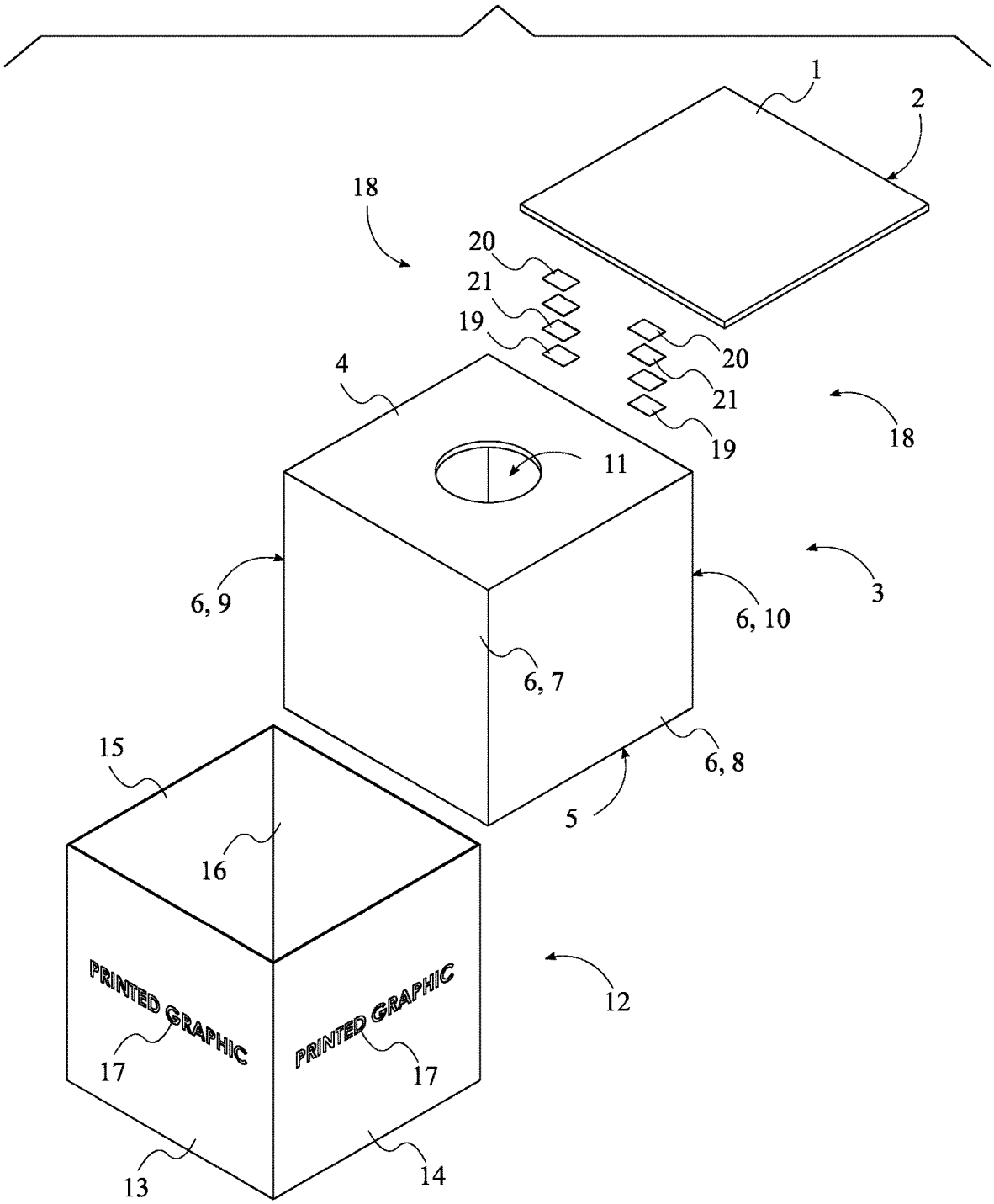
FIG. 9 is a top front exploded perspective view of the present invention.
Figure 10:
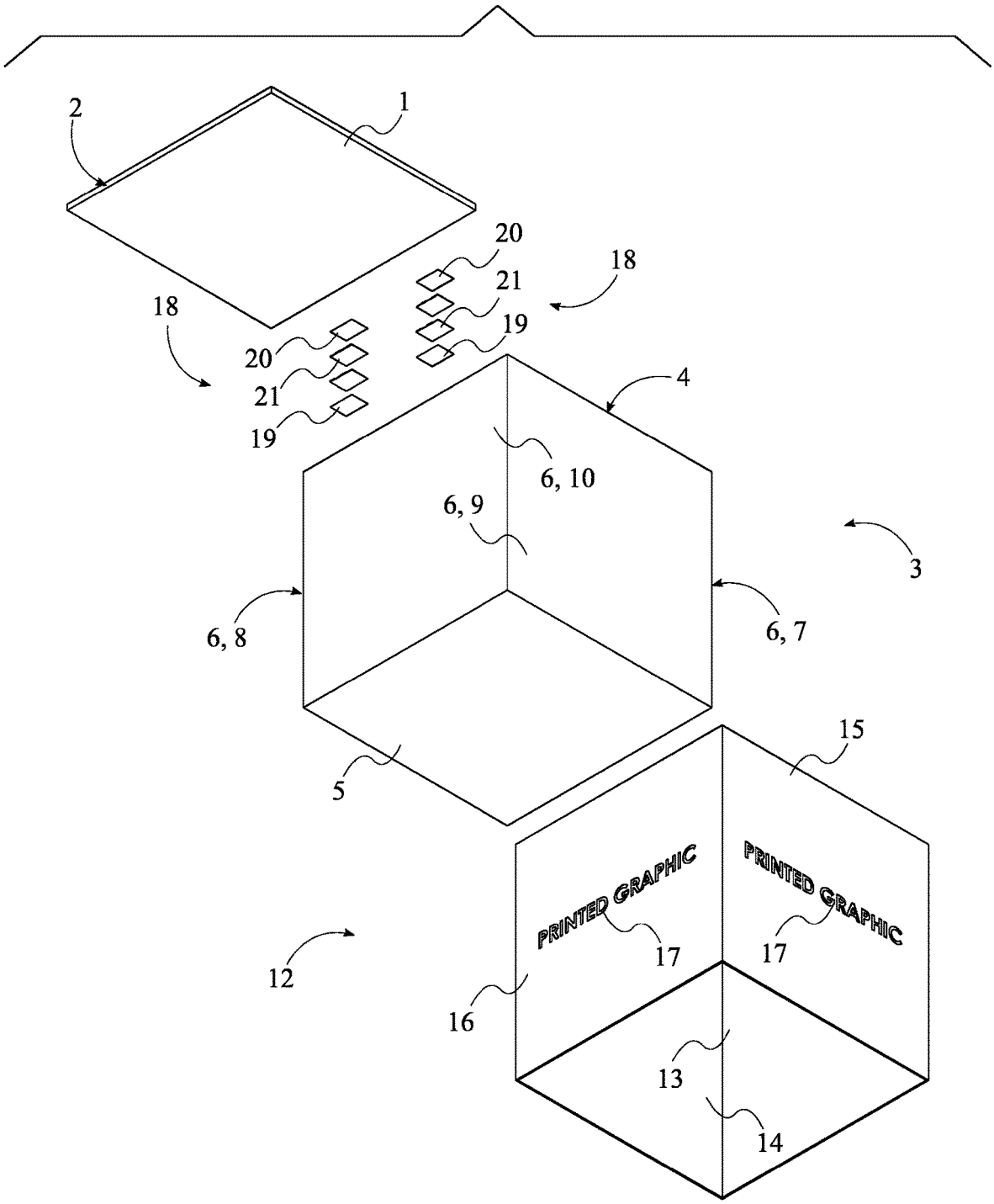
FIG. 10 is a bottom rear exploded perspective view of the present invention.

As can be seen in FIGS. 9 and 10, to further facilitate the attachment of the removable lid 1 to the storage enclosure 3, the plurality of hinges 18 is designed to be easily attached by the user. To do so, each of the plurality of hinges 18 may comprise a first adhesive piece 19, a second adhesive piece 20, and a transparent hinge body 21. The first adhesive piece 19 and the second adhesive piece 20 facilitate the attachment of the transparent hinge body 21 to the storage enclosure 3 and the removable lid 1. The transparent hinge body 21 is preferably made from plastic transparent acrylic with the dimensions of 1 inch by 1.37 inches by 0.23 inches. The plurality of hinges 18 are also positioned 3 inches apart from each other. The first adhesive piece 19 and the second adhesive piece 20 are mounted onto the transparent hinge body 21. Further, the first adhesive piece 19 and the second adhesive piece 20 are positioned offset from each other so that the first adhesive piece 19 and the second adhesive piece 20 are not in contact with each other. The first adhesive piece 19 is attached onto the top base panel 4, while the second adhesive piece 20 is attached onto the removable lid 1. This way, the removable lid 1 is securely connected to the removable lid 1 without obstructing with the attachment of the enclosure sleeve 12. In other embodiments, different connectors may be used to secure the removable lid 1 to the storage enclosure 3.

Although the invention has been explained in relation to its preferred embodiment, it is to be understood that many other possible modifications and variations can be made without departing from the spirit and scope of the invention.

What is claimed is:

1. A plastic bag storage container comprising:

a removable lid;

a storage enclosure;

an enclosure sleeve;

at least one printed graphic;

a plurality of hinges;

the removable lid comprising a lid edge;

the storage enclosure comprising a top base panel, a bottom base panel, a plurality of lateral panels, and a main opening;

each of the plurality of hinges comprising a first adhesive piece, a second adhesive piece, and a transparent hinge body;

the top base panel and the bottom base panel being positioned parallel and offset from each other;

the plurality of lateral panels being positioned in between the top base panel and the bottom base panel;

the main opening traversing through the top base panel;

the removable lid being hingedly connected to the storage enclosure, adjacent to the top base panel;

the enclosure sleeve being compressively positioned around the plurality of lateral panels;

the at least one printed graphic being externally inscribed onto the enclosure sleeve;

the plurality of hinges being distributed along the lid edge;

the removable lid being hingedly connected to the storage enclosure by the plurality of hinges;

the first adhesive piece and the second adhesive piece being mounted onto the transparent hinge body;

the first adhesive piece and the second adhesive piece being positioned offset from each other;

the first adhesive piece being attached onto the top base panel; and the second adhesive piece being attached onto the removable lid.

2. The plastic bag storage container as claimed in claim 1 comprising:

the plurality of lateral panels comprising a front lateral panel, a left lateral panel, a right lateral panel, and a rear lateral panel;

the left lateral panel being connected adjacent and perpendicular to the front lateral panel;

the right lateral panel being connected adjacent and perpendicular to the front lateral panel, opposite to the left lateral panel;

the rear lateral panel being connected adjacent and perpendicular to the left lateral panel, opposite to the front lateral panel;

the rear lateral panel being connected adjacent and perpendicular to the right lateral panel, opposite to the front lateral panel; and the front lateral panel, the left lateral panel, the rear lateral panel, and the right lateral panel being connected perpendicular in between the top base panel and the bottom base panel.

3. The plastic bag storage container as claimed in claim 2, wherein the top base panel, the bottom base panel, the front lateral panel, the left lateral panel, the rear lateral panel, and the right lateral panel are shaped into a cube.

4. The plastic bag storage container as claimed in claim 2 comprising:

the enclosure sleeve comprising a front lateral section, a left lateral section, a right lateral section, and a rear lateral section;

the front lateral section being positioned across the front lateral panel;

the front lateral section being coextensive with the front lateral panel;

the rear lateral section being positioned across the rear lateral panel;

the rear lateral section being coextensive with the rear lateral panel;

the left lateral section being positioned across the left lateral panel;

the left lateral section being coextensive with the left lateral panel;

the right lateral section being positioned across the right lateral panel; and the right lateral section being coextensive with the right lateral panel.

5. The plastic bag storage container as claimed in claim 1, wherein the main opening is centrally positioned to the top base panel.

6. The plastic bag storage container as claimed in claim 1, wherein the main opening is a circular opening.

7. The plastic bag storage container as claimed in claim 1, wherein the removable lid is shaped coextensive with the top base panel.

* * * * *